US006953319B2

(12) United States Patent
Sohn et al.

(10) Patent No.: US 6,953,319 B2
(45) Date of Patent: Oct. 11, 2005

(54) CENTRIFUGAL FAN

(75) Inventors: Sang-Bum Sohn, Seoul (KR); Wan-Ho Jeon, Incheon (KR); Ho-Seon Rew, Seoul (KR); Sung-Bae Song, Anyang (KR)

(73) Assignee: LG Electronics Inc., Seoul (KR)

( * ) Notice: Subject to any disclaimer, the term of this patent is extended or adjusted under 35 U.S.C. 154(b) by 31 days.

(21) Appl. No.: 10/404,149

(22) Filed: Apr. 2, 2003

(65) Prior Publication Data

US 2004/0018083 A1 Jan. 29, 2004

(30) Foreign Application Priority Data

Jul. 25, 2002 (KR) ..... 10-2002-0043952
Aug. 19, 2002 (KR) ..... 10-2002-0048994
Aug. 19, 2002 (KR) ..... 10-2002-0048990

(51) Int. Cl.[7] ..... F01D 25/36
(52) U.S. Cl. ..... 415/119; 415/203; 415/206; 415/214.1
(58) Field of Search ..... 415/119, 203, 415/204, 206, 213.1, 214.1, 211.2, 211.1

(56) References Cited

U.S. PATENT DOCUMENTS 2,171,342 A * 8/1939 McMahan ..... 415/119
5,281,092 A 1/1994 Sullivan
5,399,068 A 3/1995 Park
5,839,879 A 11/1998 Kameoka et al.
5,951,907 A 9/1999 Kang
5,997,246 A * 12/1999 Humbad ..... 415/119
6,168,378 B1 1/2001 Craw et al.
6,200,093 B1 * 3/2001 Lee et al. ..... 415/204
6,254,336 B1 7/2001 Ahn
6,439,839 B1 8/2002 Song et al.
6,461,103 B2 10/2002 Kim
6,478,538 B2 11/2002 Kim
6,677,564 B1 1/2004 Sohn et al.
6,767,184 B2 7/2004 Kim et al.

FOREIGN PATENT DOCUMENTS

CN 1243224 2/2000

* cited by examiner

*Primary Examiner*—Edward K. Look
*Assistant Examiner*—Dwayne J. White
(74) *Attorney, Agent, or Firm*—Greenblum & Bernstein, P.L.C.

(57) ABSTRACT

A centrifugal fan includes: a housing installed at both sides of a driving motor and having an air suction opening and an air discharge opening; an impeller installed inside the housing and discharging air sucked through the air suction opening through the air discharge opening while being rotated by the driving motor; a motor bracket coupled to one side of the housing and connecting the housing the driving motor; and a noise reducing unit for minimizing a noise of air discharged to the air discharge opening.

27 Claims, 13 Drawing Sheets

CENTRIFUGAL FAN

BACKGROUND OF THE INVENTION

1. Field of the Invention

The present invention relates to a centrifugal fan and, more particularly, to a centrifugal fan installed in a combination ventilated hood and microwave oven.

2. Description of the Background Art

In general, a combination ventilated hood and microwave oven (or, OTR (Over the Range)) is mainly used at homes and performs a cooking function by using microwave of a magnetron installed within a microwave oven body. Foul air generated in cooking in the microwave oven is ventilated by using a centrifugal fan installed at a wall surface of a space portion of an upper side of the microwave oven body.

FIG. 1 is a vertical-sectional view showing the interior of a general combination ventilated hood and microwave oven. As illustrated, the combination ventilated hood and microwave oven includes: a main body 1 having a cavity (C) to receive a food stuff; a case 3 positioned to cover the main body 1 and having an exhaust path 2 at both sides thereof; and a centrifugal fan 10 installed at a rear upper portion of the main body 1.

A rotational tray 5 is installed inside the main body 1 to rotate the food stuff received inside the cavity (C).

A magnetron 6 is installed outside the main body 1 to radiate microwave.

An air suction opening 7 is formed at a lower surface of the case 3, communicating with the exhaust path 2, and an air discharge opening 8 is formed at a rear upper portion of the case 3, communicating with the exhaust path 2.

With the combination ventilated hood and microwave oven, a user opens a door (not shown), mounts a food stuff on the rotational tray 5, and presses down an operation button (not shown). Then, the rotational tray 5 is rotated and at the same time the magnetron 6 radiates microwave to cook the food stuff.

In case of cooking a food stuff by using a gas oven (not shown) installed at a lower side of the microwave oven, the user presses down a hood operation button. Then, the centrifugal fan 10 is operated to suck air through the air suction opening 7. The sucked air is discharged outwardly through the exhaust path 2 and air discharge opening 8.

FIG. 2 is a perspective view showing a bi-suction type centrifugal fan in accordance with a conventional art, FIG. 3 is a plan view showing the bi-suction type centrifugal fan in accordance with the conventional art, and FIG. 4 is a vertical-sectional view showing the bi-suction type centrifugal fan in accordance with the conventional art.

As illustrated, in the conventional bi-suction type centrifugal fan 10, a housing 12 is positioned at both sides of a driving motor 11, an air suction opening 12*a* is formed at one side and an air discharge opening 12*b* is formed at the other side.

An impeller 13 is rotatably installed inside the housing 12 so that air sucked through the air suction opening 12*a* can be discharged through the air discharge opening 12*b* while the impeller 13 is rotated by the driving motor 11.

The impeller 13 includes a plurality of blades 13*a*, a middle plate 13*b* for serving as a reinforcing member and being coupled to a shaft (not shown) of the driving motor 11 at its middle portion, and a rim 13*c* for connecting the blades 13*a* and being formed at both ends thereof.

As for the both sides of the housing 12, if it is assumed that a portion where the air suction opening 12*a* is a bell-mouth side and a portion adjacent to the driving motor 11 is a motor bracket side, a motor bracket 14 is coupled to the motor bracket side.

The motor bracket 14 is coupled to the housing 12 so that the impeller 13 can be positioned inside the housing 12, and the motor bracket 14 serves to support the housing 12 by the driving motor 11.

The motor bracket 14 is coupled to the housing 12 so that a cut-off portion 15 is formed at an end of the air discharge opening 12*b*, and a V-shaped bent portion 15*a* is formed at the central portion of the cut-off portion 15.

The motor bracket 14 includes an air suction opening 14*a* at its central portion so that the air suction opening 14*a* can suck air to cool the driving motor 11.

In the bi-suction type centrifugal fan constructed as described above, as power is applied to the driving motor 11, the driving motor 11 is rotated and the impeller 13 fixed at the driving motor 11 is also rotated. At this time, suction force is generated so that external air is sucked into the housing 12 through the air suction opening 12*a*.

The air introduced through the air suction opening 12*a* of the housing 12 is discharged to the air discharge opening 12*b* by the rotational force of the impeller 13.

And then, the driving motor 11 is cooled by the air introduced through the air suction opening 14*a* of the motor bracket 14.

However, in the conventional bi-suction type centrifugal fan, when air sucked into the scroll housing is discharged through the air discharge opening by the rotation of the impeller, very severe noise occurs from a blade passing frequency (BPF) in proportion to the number of blades of the impeller. Such a noise is most severe at the cut-off portion 15 positioned near the blade 13*a* of the impeller 13.

In addition, as air is discharged through the air discharge opening 12*b*, a flow noise occurs, which is the most severe at the cut-off portion 15.

Moreover, since the air sucked into the housing 12 from the motor bracket side flows in whirls at the inner side of the motor bracket 14 with a plane shape, there is a technical difficulty in heightening a discharge air volume and reducing the noise.

Furthermore, when air introduced into the housing 12 is discharged through the air discharge opening 12*b*, the air flow is inclined at the bent portion 15*a* of the cut-off portion 15, resulting in increase in a noise. Such a noise is known to be more increased if the bent portion 15*a* of the cut-off portion 15 comes at the same vertical line with the middle plate 13*b* of the impeller 13.

SUMMARY OF THE INVENTION

Therefore, an object of the present invention is to provide a centrifugal fan that is capable of considerably reducing a noise while maintaining a discharge air volume.

To achieve these and other advantages and in accordance with the purpose of the present invention, as embodied and broadly described herein, there is provided a centrifugal fan including: a housing installed at both sides of a driving motor and having an air suction opening and an air discharge opening; an impeller installed inside the housing and discharging air sucked through the air suction opening through the air discharge opening while being rotated by the driving motor; a motor bracket coupled to one side of the housing and connecting the housing the driving motor; and a noise reducing unit for minimizing a noise of air discharged to the air discharge opening.

In the centrifugal fan of the present invention, the noise reducing unit is a sound insulating plate which covers an outer side of the housing at an end of the cut-off portion.

In the centrifugal fan of the present invention, the sound insulating plate is formed to cover a portion of the outer surface of the housing in a clamp shape.

In the centrifugal fan of the present invention, the noise reducing unit is a first guide member provided at an inner side of the motor bracket adjacent to the discharge opening.

In the centrifugal fan of the present invention, the first guide member can be formed integrally with the motor bracket or formed as a separate member.

In the centrifugal fan of the present invention, the first guide member is formed to be gradually protruded as it goes from the inner side of the motor bracket to the discharge opening.

In the centrifugal fan of the present invention, a second guide member can be additionally formed at the inner side of the housing adjacent to the discharge opening.

In the centrifugal fan of the present invention, the noise reducing unit is a passage recess formed at the inner side of the motor bracket.

In the centrifugal fan of the present invention, the passage recess is formed to be gradually widened as it goes toward the air discharge opening.

In the centrifugal fan of the present invention, with the noise reducing unit, a bent portion of a cut-off portion formed at an end of the air discharge opening is positioned to deviate from the middle plate formed at the middle of the impeller.

In the centrifugal fan of the present invention, on the basis of the middle plate, the distance (I) from the middle plate to the bent portion of the cut-off portion is preferably within 20~30% of the distance (L) from the middle plate to the end of the impeller. In the centrifugal fan of the present invention, on the basis of the middle plate, the horizontal length and diameter of the impeller can be different, and the number of blades of both sides and the length of the blade can be different.

In the centrifugal fan of the present invention, the bent portion of the cut-off portion can be formed to be bent in a multi-step and can be vertically or horizontally positioned.

To achieve the above objects, there is also provided a centrifugal fan including: a housing installed at one side of the driving motor and having an air suction opening and an air discharge opening; an impeller installed inside the housing and discharging air sucked through the air suction opening through the air discharge opening by being rotated by the driving motor; a motor bracket coupled at one side of the housing to connect the housing and the driving motor; and a noise reducing unit for minimizing a noise of air discharged to the air discharge opening.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 7 is a vertical-sectional view showing another example of the sound insulating plate of. FIG. 5;

DETAILED DESCRIPTION OF THE PREFERRED EMBODIMENTS

Reference will now be made in detail to the preferred embodiments of the present invention, examples of which are illustrated in the accompanying drawings.

Figure 1:
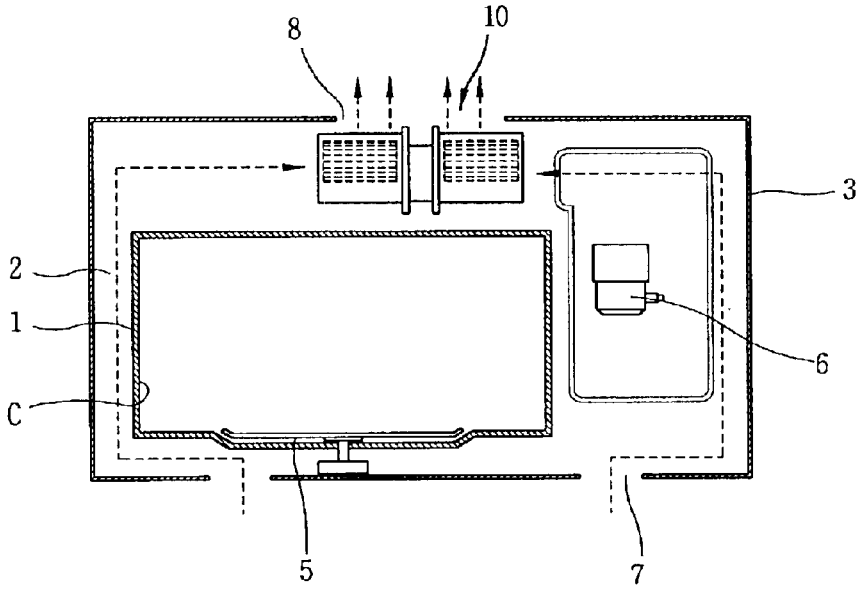
FIG. 1 CONVENTIONAL ART
FIG. 1 is a vertical-sectional view showing the interior of a general combination ventilated hood and microwave oven.
Figure 2:
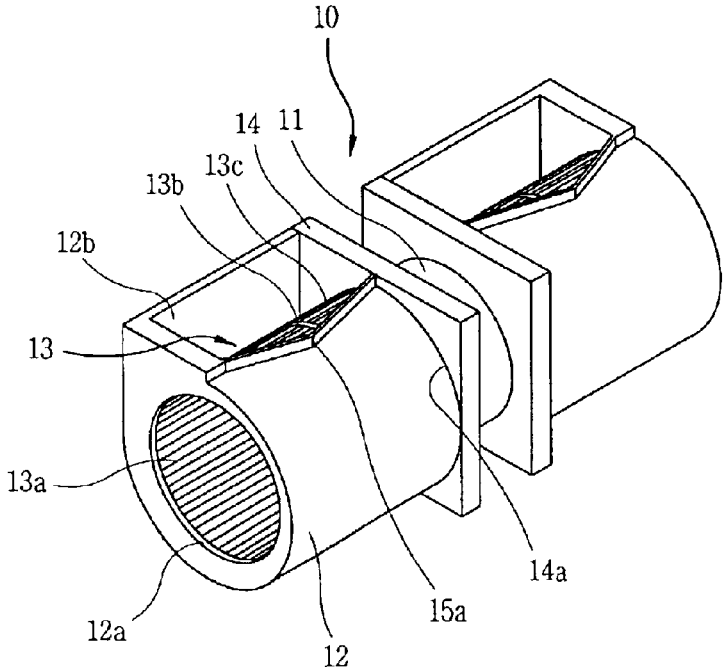
FIG. 2 CONVENTIONAL ART
FIG. 2 is a perspective view showing a bi-suction type centrifugal fan in accordance with a conventional art.
Figure 3:
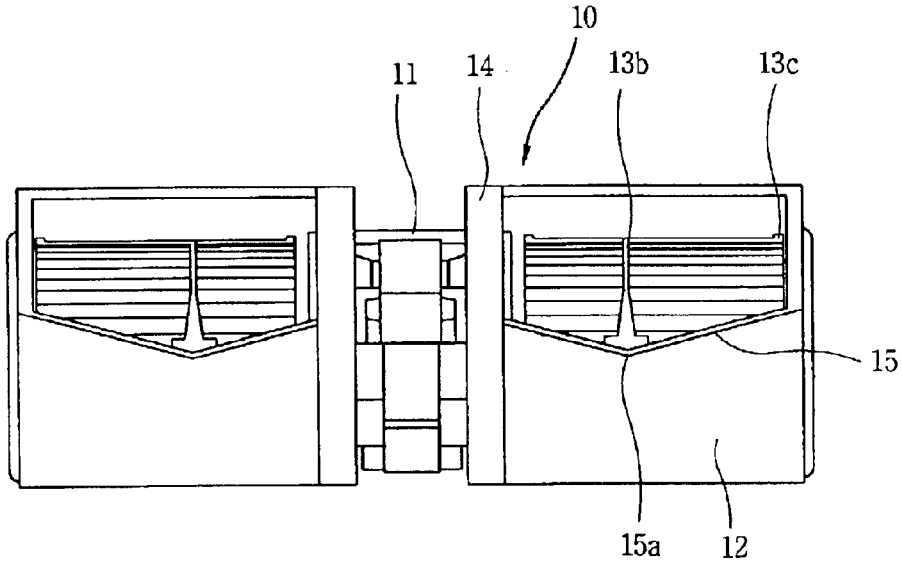
FIG. 3 CONVENTIONAL ART
FIG. 3 is a plan view showing the bi-suction type centrifugal fan in accordance with the conventional art.
Figure 4:
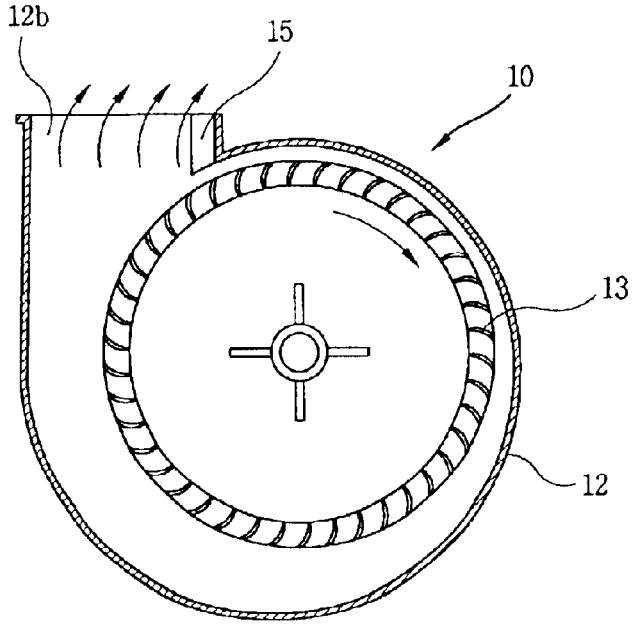
FIG. 4 CONVENTIONAL ART
FIG. 4 is a vertical-sectional view showing the bi-suction type centrifugal fan in accordance with the conventional art.
Figure 5:
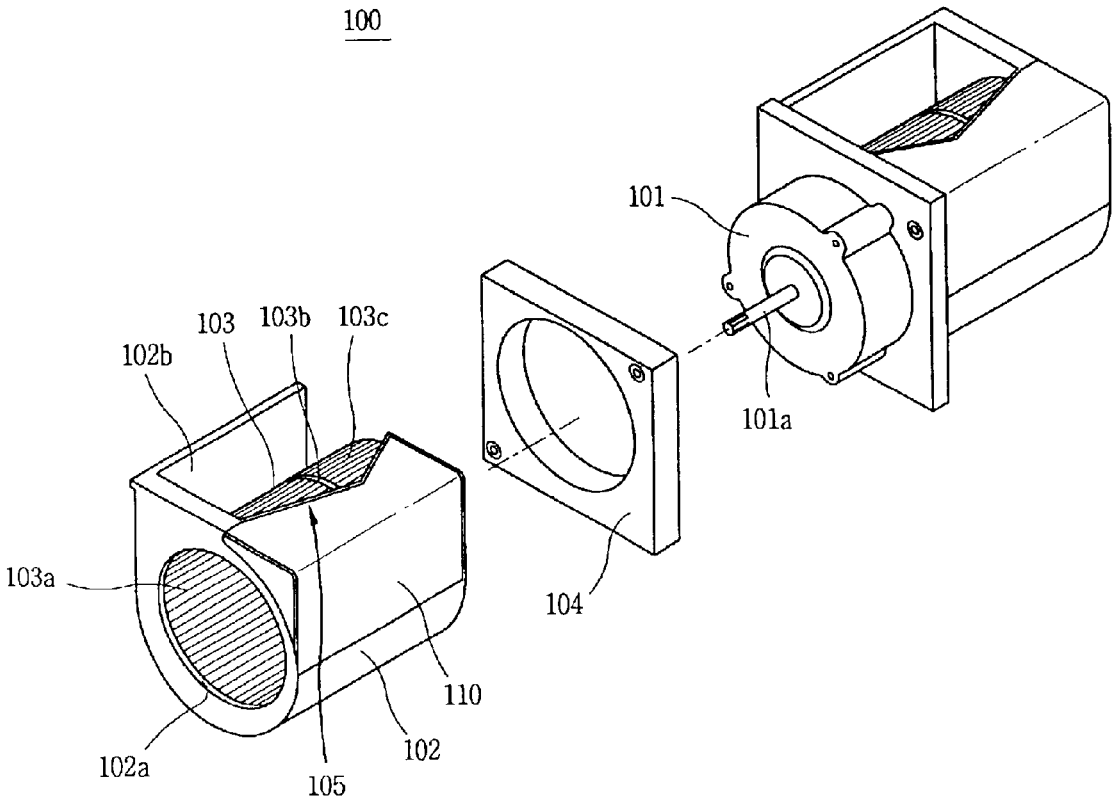
FIG. 5 is a perspective view showing a centrifugal fan in accordance with a first embodiment of the present invention.
Figure 6:
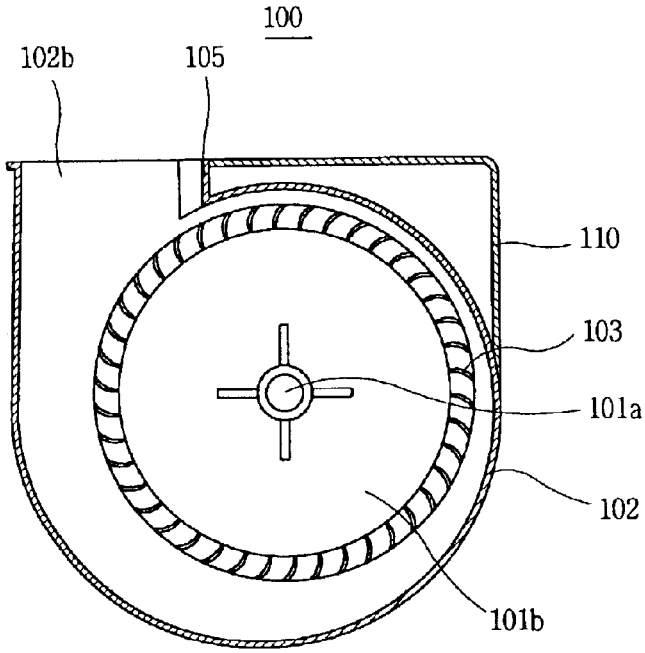
FIG. 6 is a vertical-sectional view showing one example of a sound insulating plate of FIG. 5.
Figure 7:
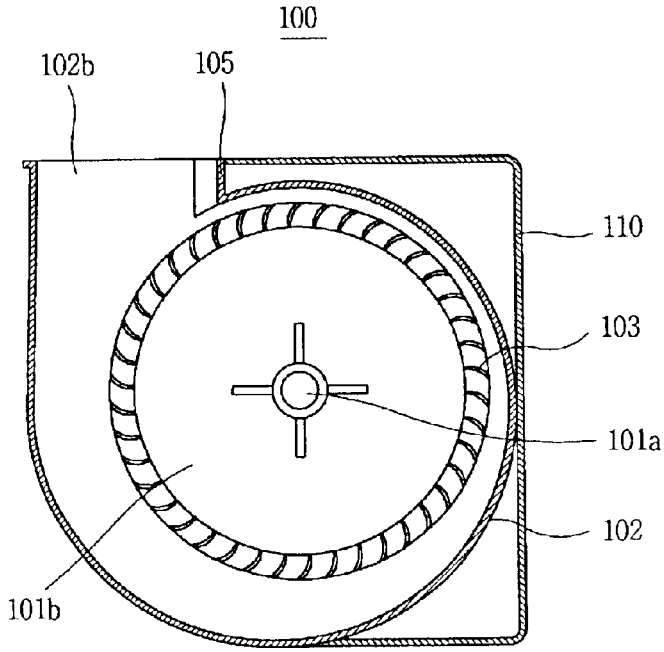
Figure 8:
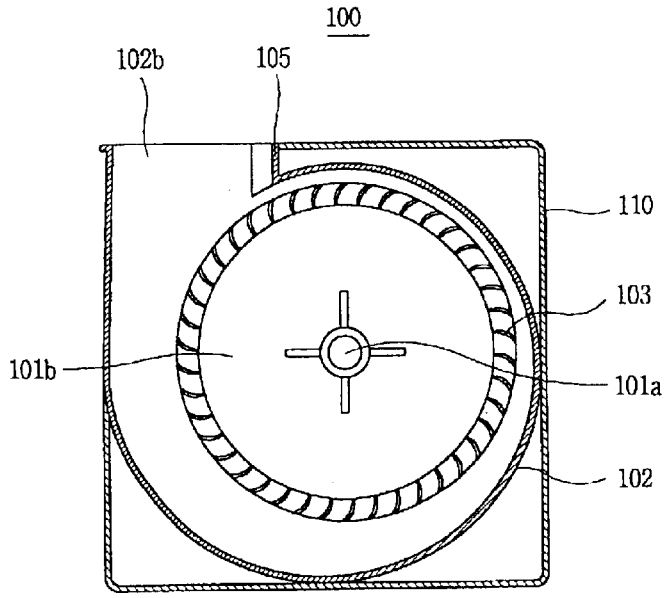
FIG. 8 is a vertical-sectional view showing a still another example of the sound insulating plate of FIG. 5.
Figure 9:
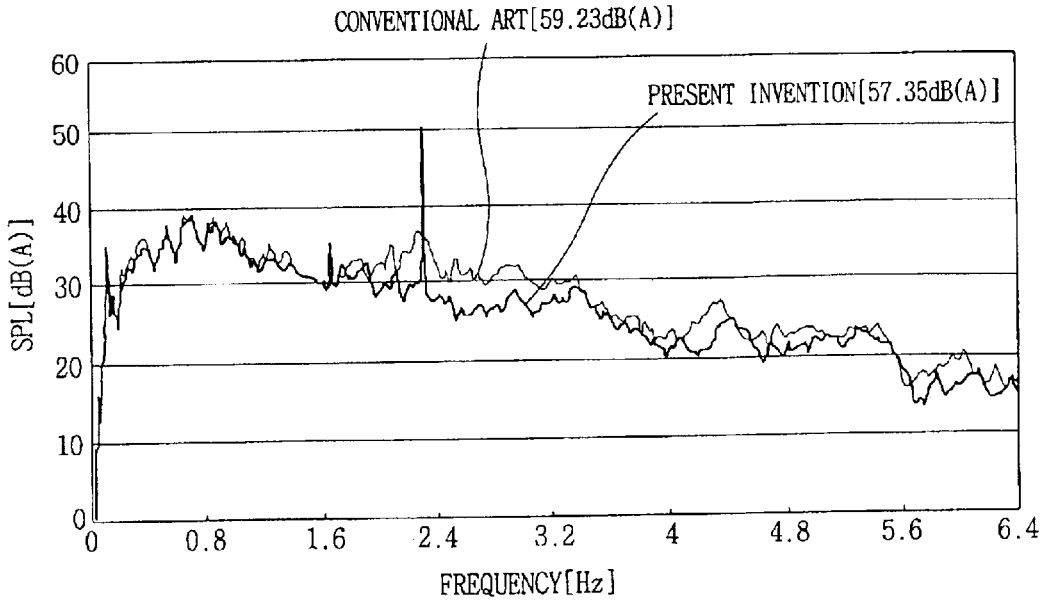
FIG. 9 is a graph showing a comparison of a noise level between the first embodiment of FIG. 5 and the conventional art.

FIG. 5 is a perspective view showing a centrifugal fan in accordance with a first embodiment of the present invention, FIG. 6 is a vertical-sectional view showing one example of a sound insulating plate of FIG. 5, FIG. 7 is a vertical-sectional view showing another example of the sound insulating plate of FIG. 5, FIG. 8 is a vertical-sectional view showing a still another example of the sound insulating plate of FIG. 5, and FIG. 9 is a graph showing a comparison of a noise level between the first embodiment of FIG. 5 and the conventional art.

As illustrated, a centrifugal fan 100 includes a housing 102 installed at both sides of a driving motor 101 and having an air suction opening 102 and an air discharge opening 102*b*; an impeller 103 installed inside the housing 102 and discharging air sucked through the air suction opening 102 through the air discharge opening 102*b* by being rotated by the driving motor 101; a motor bracket 104 coupled at one side of the housing 102 to connect the housing 102 and the driving motor 101; and a noise reducing unit for minimizing a noise of air discharged to the air discharge opening 102*b*.

The housing 102 is positioned at both sides of the driving motor 101. The air suction opening 102 is formed at one side of the housing 102, while the air discharge opening 102*b* is formed at the other side of the housing 102.

The impeller 103 is rotatably installed inside the 102 so that air sucked through the air suction opening 102*a* can be discharged through the air discharge opening 102*b* while the impeller 13 is rotated by the driving motor 11.

The impeller 103 includes a plurality of blades 103*a*, a middle plate 103*b* for serving as a reinforcing member and being coupled to a shaft 101*a* of the driving motor 101 at its middle portion, and a rim 103*c* for connecting the blades 103*a* and being formed at both ends thereof.

As for the both sides of the housing 102, if it is assumed that a portion where the air suction opening 102*a* is a bell-mouth side and a portion adjacent to the driving motor 101 is a motor bracket side, a motor bracket 104 is installed at the motor bracket side.

The motor bracket 104 can be integrally formed with the housing 102, but it usually constructed to be attached to and detached from the housing 102 because the impeller 103 is to be inserted in the housing 102.

The motor bracket 104 is coupled to the housing 102 so that the impeller 103 can be positioned inside the housing 102, and the motor bracket 104 serves to support the housing 102 by the driving motor 101.

The motor bracket 104 is coupled to the housing 102 so that a cut-off portion 105 is formed at an end of the air discharge opening 102*b*.

The motor bracket 104 includes an air suction opening 102*a* at its central portion so that the motor bracket side can suck air to cool the driving motor 101.

The cut-off portion 105 is weak in terms of its structure, causing a severe noise. In order to solve this problem, a sound insulating plate 110 is formed as a noise transmission blocking and structure reinforcing unit to cover the outer side of the housing 102 at an end of the cut-off portion 105 in accordance with a first embodiment of the present invention.

A space (S) may be formed between the sound insulating plate 110 and the housing 102 or may not be formed therebetween. In terms of light weight of the overall centrifugal fan 100, it is preferred to have a space.

The sound insulating plate 110 can be fabricated as a separate member for the housing 102, and preferably is integrally formed with the housing in order to improve its rigidity.

The sound insulating plate 110 can be formed in various shapes. As shown in FIG. 6, the sound insulating plate 110 can be in a clamp shape to cover a portion of the outer side of the housing 102, or as shown in FIGS. 7 and 8, it can be formed in a rectangular shape to cover the entire outer side of the housing 102.

The sound insulating plate 110 blocks a BPF noise and a flow noise by supporting the end of the cut-off portion 105 and the outer side of the housing 102.

The operation and effect of the centrifugal fan in accordance with the first embodiment of the present invention will now be described with reference to FIG. 5.

As illustrated, when the driving motor 101 is driven as power is applied thereto, the impeller 103 connected to the driving motor 101 is rotated. According to the rotation of the impeller 103, air is sucked through the air suction opening 102*a* and then discharged through the air discharge opening 102*b*.

At this time, the sound insulating plate 110 blocks transmission of the BPF noise and the flow noise generated from the cut-off portion 105.

FIG. 9 is a graph showing a comparison of a noise level between the first embodiment of FIG. 5 and the conventional art.

In FIG. 9, a horizontal axis indicates a frequency for rotation of the impeller, a vertical axis indicates a noise level, a dotted line indicates a first embodiment of the present invention, and a solid line indicates the conventional art.

It is noted that, under the same condition, a noise of the centrifugal fan 100 in the conventional art is 59.23 dB(A), while a noise of the centrifugal fan 100 in accordance with the first embodiment of the present invention is 57.35 dB(A).

This means that installation of the sound insulating plate can contribute to reduce a noise of about 2 dB(A), compared to the case without the sound insulating plate.

Meanwhile, in case of the general centrifugal fan, in the aspect of its structure, air sucked through the air suction opening is orbited by about 90° to be discharged through the air discharge opening, during which a vortex is generated at the inner side of the housing. In order to prevent generation of the vortex, a guide member is installed to guide air sucked through the air suction opening toward the air discharge opening in accordance with a second embodiment of the present invention.

The second embodiment of the present invention will now be described with reference to FIGS. 10 to 12.

Figure 10:
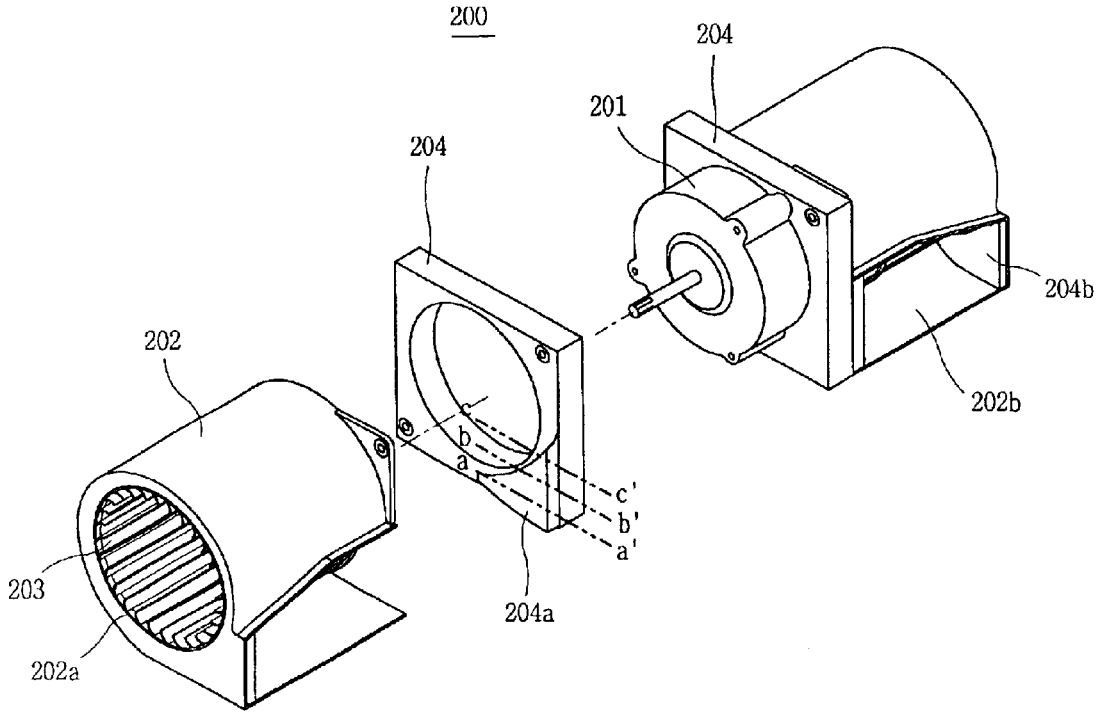
FIG. 10 is a perspective view showing a centrifugal fan in accordance with a second embodiment of the present invention.
Figure 11:
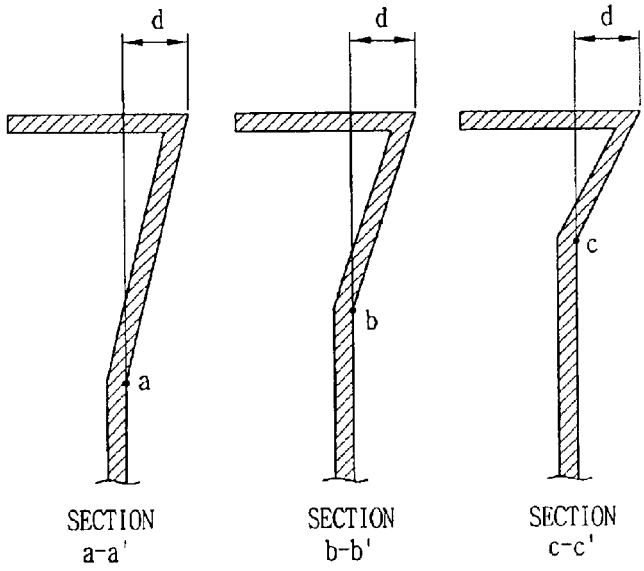
FIG. 11 is a cross section view taken along section line a–a', b–b', c–c' of FIG. 10.
Figure 12:
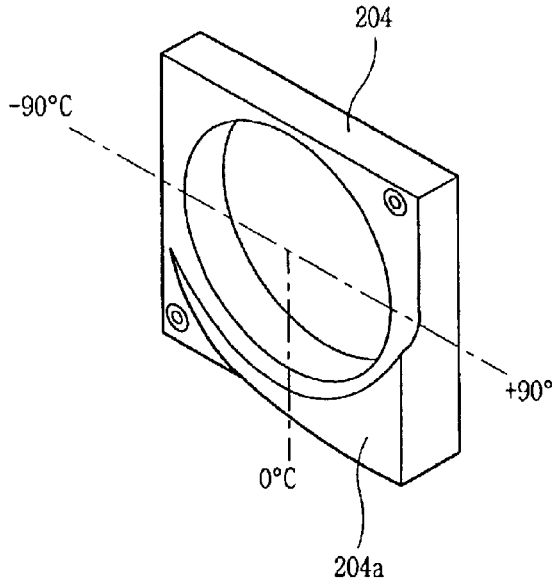
FIG. 12 is a perspective view showing a first guide member of FIG. 10.
Figure 13:
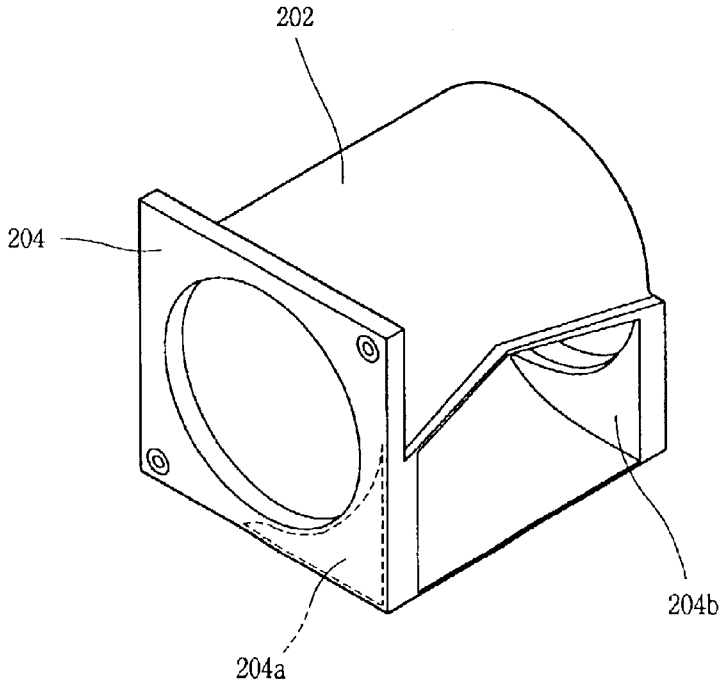
FIG. 13 is a partial perspective view showing a second guide member of FIG. 10.

FIG. 10 is a perspective view showing a centrifugal fan in accordance with a second embodiment of the present invention, FIG. 11 is a cross section view taken along section line a–a', b–b', c–c' of FIG. 10, FIG. 12 is a perspective view showing a first guide member of FIG. 10, and FIG. 13 is a partial perspective view showing a second guide member of FIG. 10.

As shown in FIG. 10, a centrifugal fan 200 in accordance with the second embodiment of the present invention includes a first guide member 204*a* formed at an inner surface of the motor bracket 204 adjacent to an air discharge opening 202*b* to minimize a BPF noise and a flow noise of air being discharged toward the air discharge opening 202*b*.

The first guide member 204*a* serves to guide flowing of air being introduced through the air suction opening 202*a* of the motor bracket 204.

The first guide member 204*a* can be formed as a separate member with respect to the motor bracket 204, and preferably, it is formed integrally with the motor bracket 204 to promote improvement of rigidity.

The first guide member 204*a* is formed to be gradually protruded as it goes from the inner side of the motor bracket 204 toward the air discharge opening 102*b*.

The first guide member 204*a* can be formed at an upper portion of the inner side wall of the motor bracket, or as shown in FIG. 11, it can be formed over the upper and lower portions of the inner side wall of the motor bracket (assuming air discharge opening side is upper).

In deciding the width of the first guide member 204*a*, the first guide member preferably has a width within 5~10% of the that of the air discharge opening in order to smoothly induce air flow.

With reference to FIG. 13, a second guide member 204*b* can be installed at the inner side of the housing 202 adjacent to the air discharge opening 202*b*.

The second guide member 204*b* guides flowing of air being introduced through the air suction hole 202*a* of the housing 202.

The operation and effect of the centrifugal fan in accordance with the second embodiment of the present invention will now be described with reference to FIGS. 10 to 13.

As illustrated, when the driving motor 201 is driven as power is applied thereto, the impeller 203 connected to the driving motor 201 is rotated.

According to rotation of the impeller 203, air is sucked through the air suction opening 202*a*, which is then orbited by 90° and discharged through the air discharge opening 202*b*.

At this time, the air sucked into the impeller 203 through the air suction opening 202*a* is guided by the first guide member 204*a* and discharged through the air discharge opening 202*b*, and at the same time, the air sucked into the impeller 203 through the air suction opening 202*a* is guided by the second guide member 204*b* and discharged through the air discharge opening 202*b*.

That is, the sucked air is smoothly guided toward the air discharge opening 202*b* by the first guide member 204*a* and the second guide member 204*b*, so that no vortex is generated at the inner side of the housing 202 and the noise can be considerably reduced.

Figure 14:
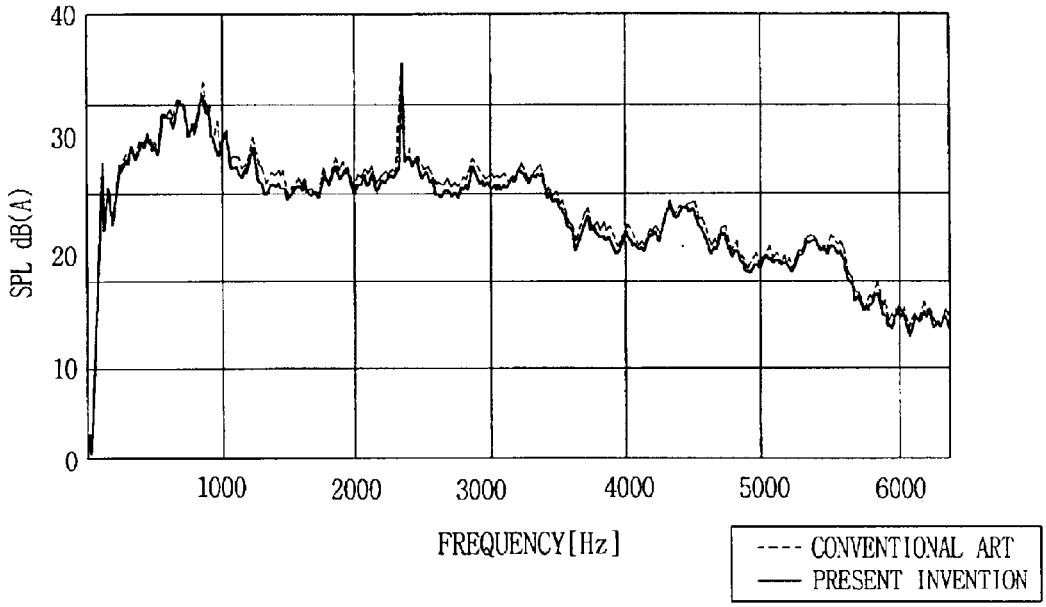
FIG. 14 is a graph showing a comparison of a noise level between a second embodiment of FIG. 10 and the conventional art.

FIG. 14 is a graph showing a comparison of a noise level between a second embodiment of FIG. 10 and the conventional art.

In FIG. 14, a horizontal axis indicates a frequency for rotation of the impeller, a vertical axis indicates a noise level, a thick line indicates the second embodiment of the present invention, and a dotted line indicates the conventional art.

As illustrated, under the same condition, a noise is remarkably reduced in the region of 800~1500 Hz by the first guide member 204*a* and it is noted that overall about 1 dB(A) is reduced, in accordance with the second embodiment of the present invention.

Reduction of the noise in the region of 800~1500 Hz means that a noise recognizable by human beings is much reduced in consideration that an audible region is 20~20,000 Hz.

Figure 15:
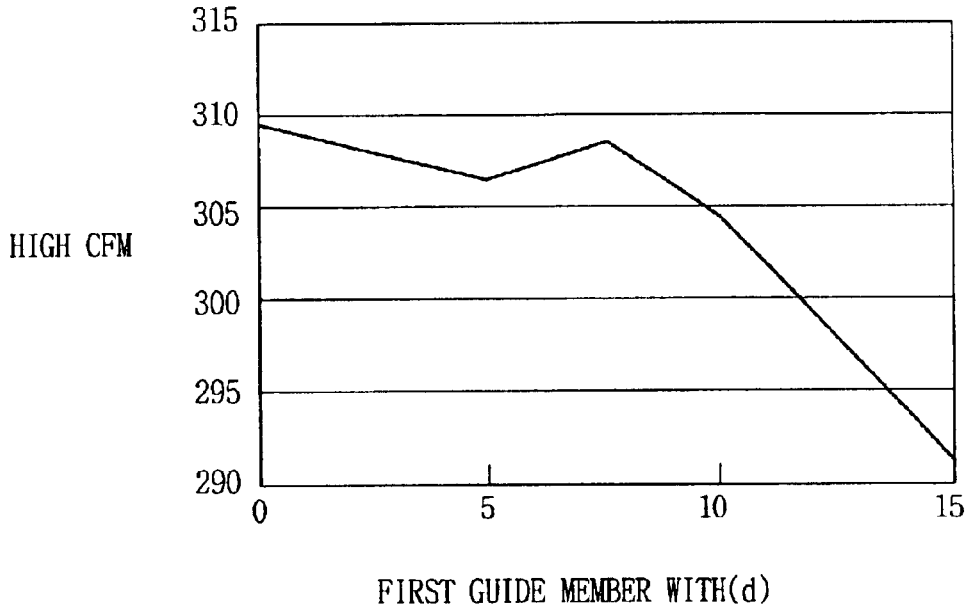
FIG. 15 is a graph showing a discharge air volume for the width of the first guide member of FIG. 10.
Figure 16:
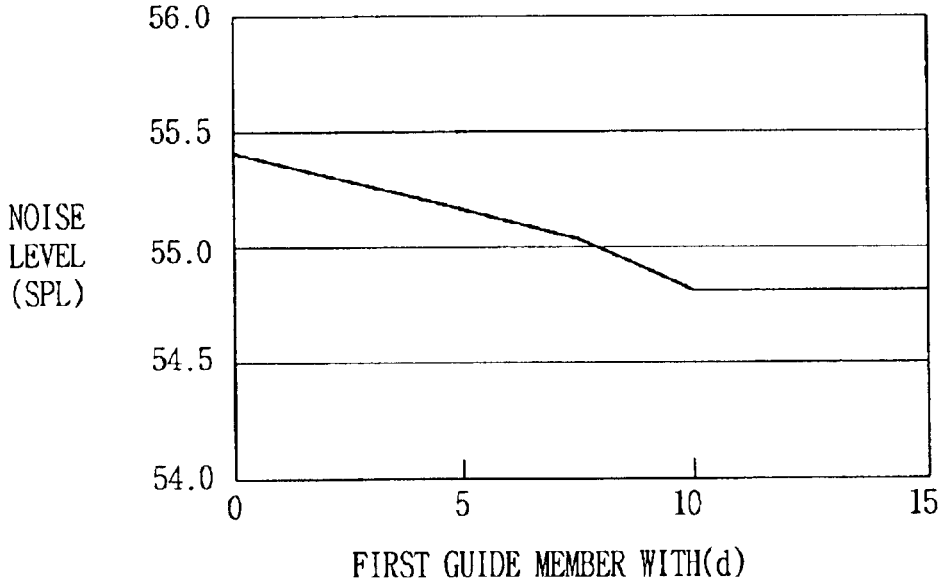
FIG. 16 is a graph showing a noise level for the width of the first guide member of FIG. 10.

FIG. 15 is a graph showing a discharge air volume for the width of the first guide member of FIG. 10, and FIG. 16 is a graph showing a noise level for the width of the first guide member of FIG. 10.

In FIG. 15, a horizontal axis indicates a width of the first guide member(d), a vertical axis indicates a discharge air volume. In FIG. 16, a horizontal axis indicates a width of the first guide member and a vertical axis indicates a noise level.

As illustrated, assuming that the width of the air discharge opening(D) is 105 m/m, discharge air volume is similar at the interval that the width of the first guide member(d) is 0~10 m/m as shown in FIG. 15 but a noise level is remarkably reduced as shown in FIG. 16.

Therefore, in the two graphs, the optimum interval where the noise can be remarkably reduced while maintaining some discharge air volume is when the first guide member has a width of 5~10 m/m.

On the assumption that the width of the air discharge opening is 105 m/m, an optimum interval is when the first guide member has a width of 5~10 m/m. Thus, the width of the first guide member(d) to the width of the air discharge opening(D) is about 0.47:1~0.94:1.

Figure 17:
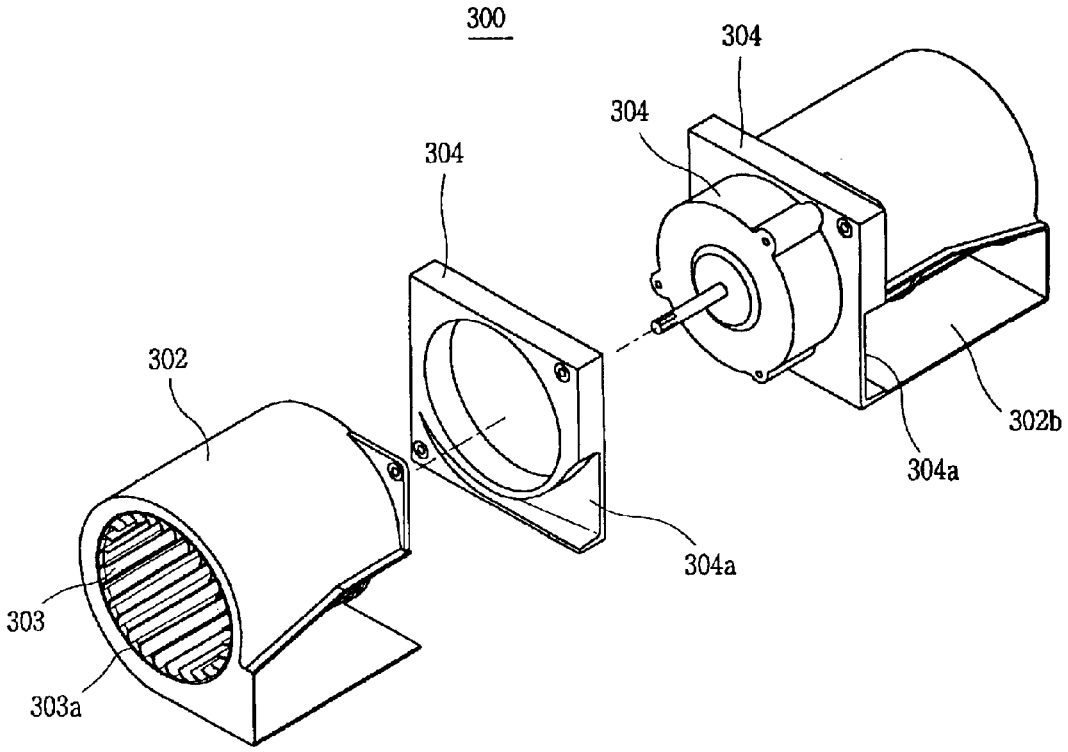
FIG. 17 is an exploded perspective view showing a centrifugal fan in accordance with a third embodiment of the present invention.

FIG. 17 is an exploded perspective view showing a centrifugal fan in accordance with a third embodiment of the present invention.

As illustrated, a centrifugal fan 300 in accordance with the third embodiment of the present invention includes a passage recess 304*a* formed at the inner side of a motor bracket 304 adjacent to an air discharge opening 302*a* in order to minimize a BPF noise and flow noise of air being discharged toward an air discharge opening 302*a*. The passage recess 304*a* is formed to be gradually widened as it goes toward the air discharge opening 302*a*, and the inner side thereof is formed rounded.

In the case that the passage recess 304*a* is formed at the inner side of the motor bracket 304, when the centrifugal fan operates, air introduced into the housing 302 through the air suction opening 302*a* is smoothly discharged along the passage recess 304*a* toward the air discharge opening 302*a*. Since the air is smoothly discharged through the air discharge opening 302*a*, no vortex is formed at the inner wall surface of the housing 302 and a noise is remarkably reduced.

Figure 18:
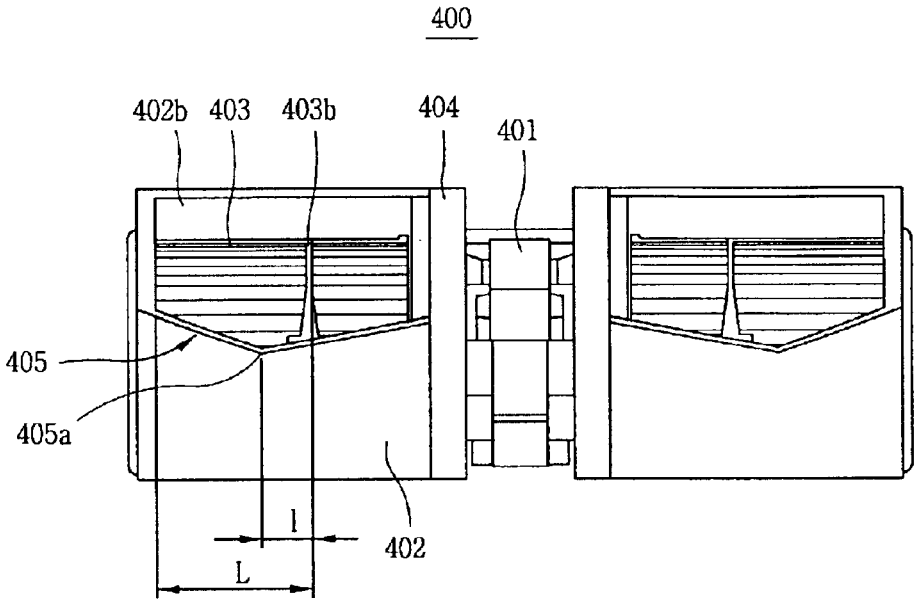
FIG. 18 is a plan view showing a centrifugal fan in accordance with a fourth embodiment of the present invention.
Figure 19:
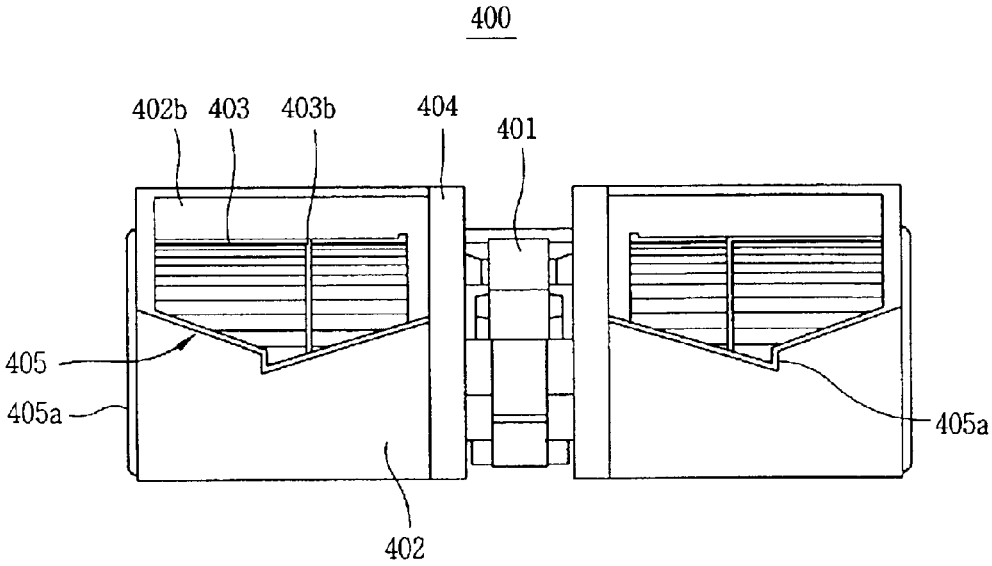
FIG. 19 is a front view showing another example of a bent portion of FIG. 18.
Figure 20:
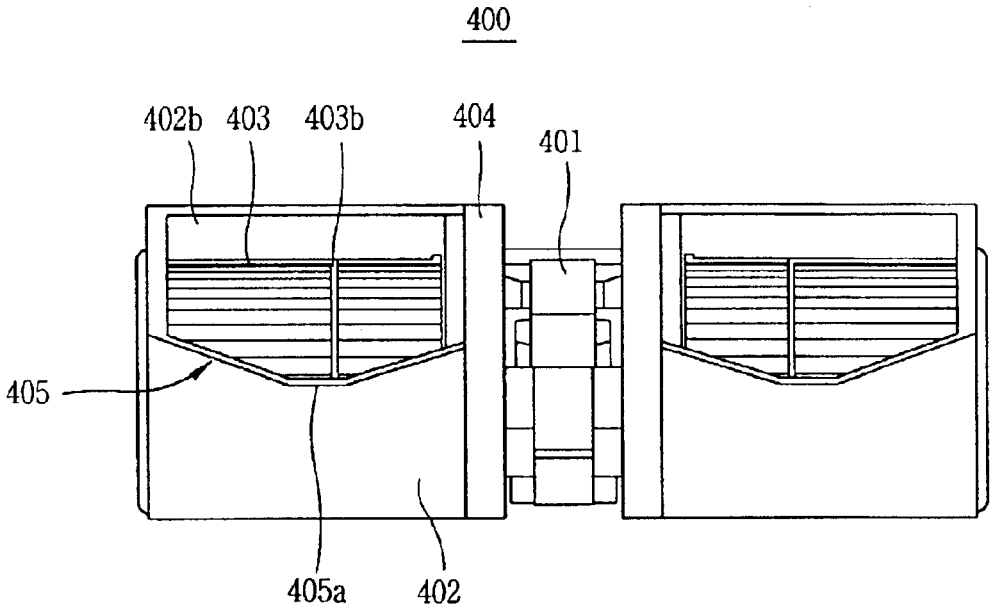
FIG. 20 is a front view showing a still another example of the bent portion of FIG. 18.

FIG. 18 is a plan view showing a centrifugal fan in accordance with a fourth embodiment of the present invention, FIG. 19 is a front view showing another example of a bent portion of FIG. 18, and FIG. 20 is a front view showing a still another example of the bent portion of FIG. 18.

As shown in FIG. 18, a bent-portion 405*a* of the cut-off portion 405 formed at an end of the 402*b* is positioned to deviate from a middle plate 403*b* formed at the middle of the impeller 403, in order to minimize BPF noise and a flow noise of air being discharged toward the air discharge opening 402*b*.

As shown in FIGS. 19 and 20, the bent portion 405*a* can be formed vertically or horizontally, or also can be formed with a multi-step (not shown).

With reference to FIG. 18, in the centrifugal fan 400 in accordance with the fourth embodiment of the present invention, the impeller 403 connected to the driving motor 101, according to which air is sucked through the air suction opening 40. The thusly sucked air is orbited by 90° and then discharge through the air discharge opening 402*b*.

At this time, because the bent portion 405*a* of the cut-off portion 405 is positioned to deviate from the middle plate 403*b*, the sucked air is not inclined to the center of the air discharge opening 402*b*.

Therefore, without the phenomenon that air flow is inclined, a noise can be remarkably reduced.

Figure 21:
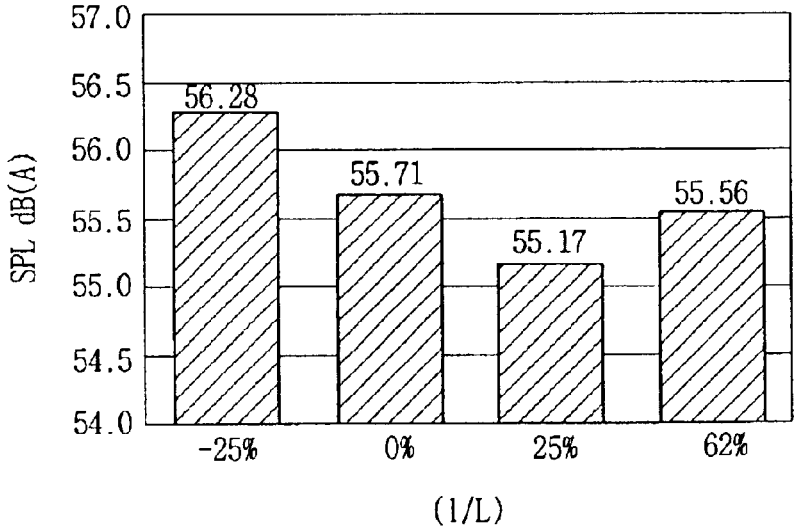
FIG. 21 is a bar graph showing a noise level of a distance from a middle plate to a bent portion for a distance from the middle plate to the end of an impeller on the basis of the middle plate of FIG. 18.

FIG. 21 is a bar graph showing a noise level of a distance (I) from a middle plate to a bent portion to a distance (L)

from the middle plate to the end of an impeller on the basis of the middle plate of FIG. 18.

As illustrated, it is preferred that, on the basis of the middle plate, the distance (I) from the middle plate to the end of the bent portion 405*a* is within 20~30% of the distance (L) from the middle plate to the end of the impeller 103.

It is noted that, under the same air volume, a noise is minimized when I/L is about 25%.

Figure 22:
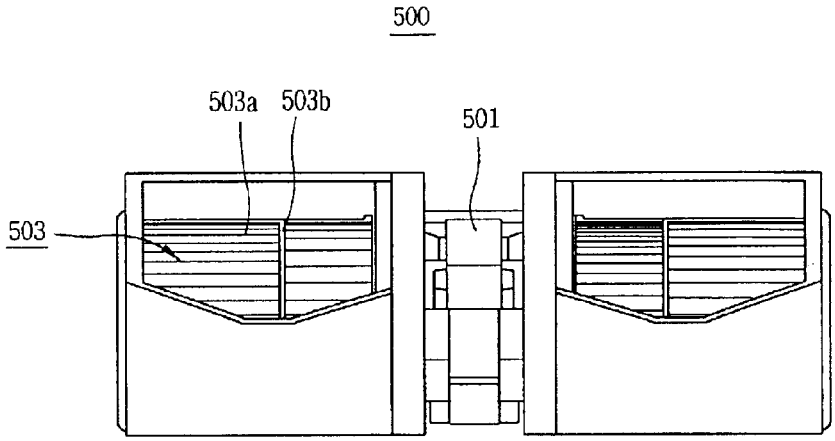
FIG. 22 is a plan view showing a centrifugal fan in accordance with a fifth embodiment of the present invention, in which the number of blades of an impeller and its length are different in left side and in right side on the basis of the middle plate.

FIG. 22 is a plan view showing a centrifugal fan in accordance with a fifth embodiment of the present invention, in which the number of blades of an impeller and its length are different in left side and in right side on the basis of the middle plate.

As illustrated, in a centrifugal fan 500 in accordance with a fifth embodiment of the present invention, the number of blades 503*a* of an impeller 503 can be different in the left side and in the right side on the basis of a middle plate 503*b*, and the length of the left and right blades 503*a* can be different.

Figure 23:
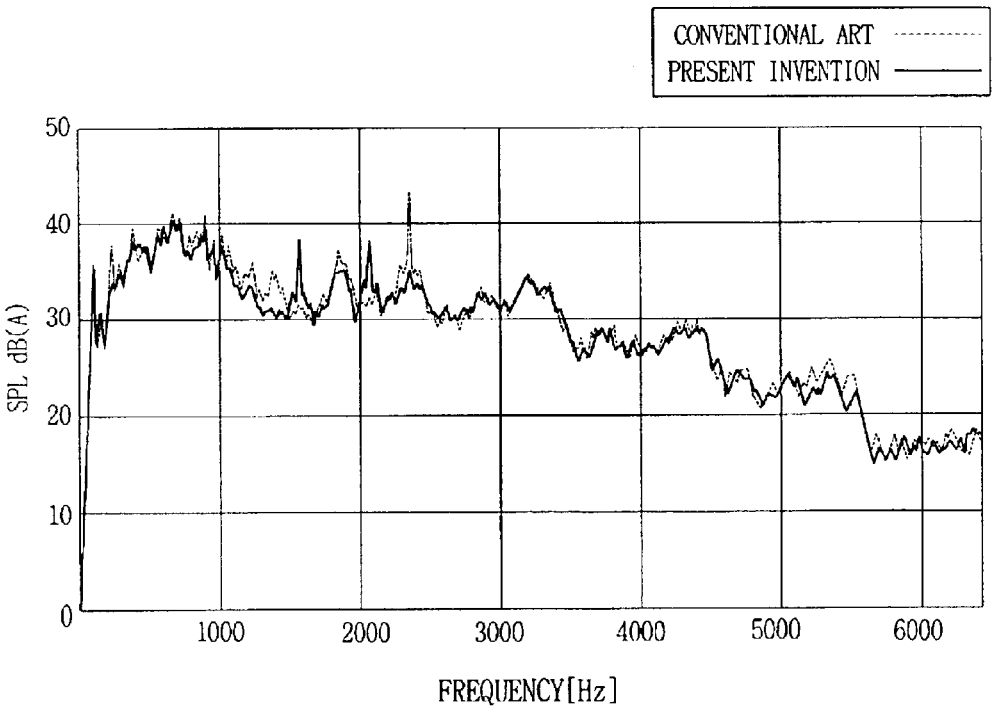
FIG. 23 is a graph showing a noise level appearing when the number of blades of the impeller of FIG. 22 differs.

FIG. 23 is a graph showing a noise level appearing when the number of blades of the impeller of FIG. 22 differs.

In FIG. 23, a horizontal axis indicates a frequency of rotation of the impeller, vertical axis indicates a noise level, a thick line indicates the present invention, and a dotted line indicates the conventional art.

In general, blade passing frequency (BPF)=the number of rotations (rpm)×(the number of blades/60). By varying the blade passing frequency by changing the number of blades to 37, 28, 42, 33, the blade passing frequency can be distributed and a noise can be minimized.

As a matter of course, the technique of the present invention can be also applied to a uni-suction type centrifugal fan, as well as the bi-suction type centrifugal fan.

As so far described, the centrifugal fan of the present invention has the following advantages.

That is, by installing the sound insulating plate at the end of the cut-off portion, by installing the first/second guide members, by positioning the middle plate and the bent portion of the cut-off portion to be deviated from each other, by having the rate of 20~30% the distance (I) from the middle plate to the end of the bent portion to the distance (L) from the middle plate to the end of the impeller on the basis of the middle plate, and by varying the number of blades of both sides of the impeller on the basis of the middle plate, the noise can be effectively reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A centrifugal fan comprising:

a driving motor that generates a driving force;

a housing having an air suction opening and an air discharge opening;

an impeller installed inside the housing and discharging air sucked through the air suction opening through the air discharge opening while being rotated by the driving motor;

a motor bracket coupled to one side of the housing and connecting the housing to the driving motor; and a noise reducing unit covering the housing at an outer side thereof and supporting an end of a cut-off portion of the air discharge opening of the housing, the noise reducing unit minimizing a noise of air discharged to the air discharge opening and reinforcing the housing.

2. The centrifugal fan of claim 1, wherein the noise reducing unit includes a sound insulating member formed at an end of the cut-off portion to cover an outer side of the housing.

3. The centrifugal fan of claim 1, wherein the noise reducing unit includes a sound insulating member formed to cover a portion of the outer side of the housing.

4. The centrifugal fan of claim 3, wherein the sound insulating member is formed in a rectangular shape to entirely cover the outer side of the housing.

5. The centrifugal fan of claim 2, wherein a space is formed between the sound insulating member and the outer side of the housing.

6. A centrifugal fan comprising:

a driving motor that generates a driving force;

a housing installed at both sides of the driving motor and having an air suction opening and an air discharge opening;

an impeller installed inside the housing and discharging air sucked through the air suction opening through the air discharge opening while being rotated by the driving motor;

a motor bracket coupled to one side of the housing and connecting the housing to the driving motor; and a noise reducing unit for minimizing a noise of air discharged to the air discharge opening, said noise reducing unit comprising a first guide member formed as a protrusion from an inner side of the motor bracket adjacent to the air discharge opening.

7. The centrifugal fan of claim 6, wherein the first guide member is formed integrally with the motor bracket.

8. The centrifugal fan of claim 6, wherein the first guide member is formed to gradually protrude from the inner side of the motor bracket to the air discharge opening.

9. The centrifugal fan of claim 6, wherein the width of the first guide member is within 5~10% of the width of the air discharge opening.

10. The centrifugal fan of claim 6, wherein a second guide member is additionally formed at the inner side of the housing adjacent to the discharge opening.

11. The centrifugal fan of claim 10, wherein the second guide member is formed to gradually protrude from the inner side of the housing to the air discharge opening.

12. A centrifugal fan comprising:

a driving motor that generates a driving force;

a housing installed at both sides of the driving motor and having an air suction opening and an air discharge opening;

an impeller installed inside the housing and discharging air sucked through the air suction opening through the air discharge opening while being rotated by the driving motor;

a motor bracket coupled to one side of the housing and connecting the housing to the driving motor; and a noise reducing unit for minimizing a noise of air discharged to the air discharge opening, said noise reducing unit comprising a passage recess formed in an inner side of the motor bracket.

13. The centrifugal fan of claim 12, wherein the passage recess is formed to gradually widen as it approaches the air discharge opening.

14. The centrifugal fan of claim 13, wherein the passage recess is rounded at its inner side.

15. The centrifugal fan of claim 1, wherein, in the noise reducing unit; a bent portion of the cut-off portion formed at the end of the air discharge opening is separated from a middle plate formed at the middle portion of the impeller by a distance.

16. The centrifugal fan of claim 15, wherein the distance from the middle plate to the end of the bent portion is about 20~30% of a distance from the middle plate to the end of the impeller.

17. The centrifugal fan of claim 15, wherein the number of the left blades of the impeller differs from the number of the right blades of the impeller.

18. The centrifugal fan of claim 15, wherein the length of the left blades of the impeller differs from the length of the right blades of the impeller.

19. The centrifugal fan of claim 15, wherein the bent portion of the cut-off portion is formed bent in a multi-step.

20. The centrifugal fan of claim 19, wherein the bent portion of the cut-off portion is vertically positioned.

21. The centrifugal fan of claim 19, wherein the bent portion of the cut-off portion is horizontally positioned.

22. A centrifugal fan, comprising:

a housing having a suction opening and a discharge opening located at an end thereof;

a motor bracket connected to one side of the housing, a portion of the motor bracket together with the discharge opening of the housing forming a cut-off portion at an end of the discharge opening of the housing;

an impeller located within the housing to receive air via the suction opening and to discharge air through the discharge opening; and a sound insulating member having a first edge connected with the discharge opening and a second edge connected with an outer surface of the housing to provide support for the cut-off portion.

23. The centrifugal fan of claim 22, wherein the sound insulating member covers less than half of the housing.

24. The centrifugal fan of claim 22, wherein the sound insulating member covers at least half of the housing.

25. The centrifugal fan of claim 22, wherein the portion of the motor bracket protrudes into the discharge opening of the housing, such that a cross-section of the discharge opening decreases in the direction of the discharging air.

26. The centrifugal fan of claim 22, further comprising a guide member which is inwardly protruded on an inner surface of the motor bracket adjacent to the discharge opening in order to guide flowing of air introduced through the suction opening, to prevent generation of a vortex inside the housing thereby and to minimize a BPF noise and a flow noise of air being discharged toward the discharge opening.

27. The centrifugal fan of claim 22, further comprising a guide member formed at an inner side of the motor bracket, wherein a width ratio (d/D) is in a range of about 5–10%, where d=width of guide member and D=width of the discharge opening.

* * * * *